US006279644B1

(12) United States Patent
Wylie

(10) Patent No.: US 6,279,644 B1
(45) Date of Patent: Aug. 28, 2001

(54) SCREEN AND FRAME ASSEMBLY IN WHICH THE SCREEN IS ADHESIVELY SECURED TO THE FRAME

(75) Inventor: Douglas H. Wylie, Waterdown (CA)

(73) Assignee: St. Gobain Bayform America Inc., Cadiz, OH (US)

( * ) Notice: Subject to any disclaimer, the term of this patent is extended or adjusted under 35 U.S.C. 154(b) by 0 days.

(21) Appl. No.: 08/997,737

(22) Filed: Dec. 24, 1997

(51) Int. Cl.[7] ..... E06B 9/24
(52) U.S. Cl. ..... 160/371; 160/378; 160/383
(58) Field of Search ..... 160/371, 391, 160/395, 378, 382, 383, 403; 156/291, 306.6, 324.4, 160, 309.6

(56) References Cited

U.S. PATENT DOCUMENTS

| | | | | |
|---|---|---|---|---|
| 1,058,616 | | 4/1913 | Maze . | |
| 2,791,264 | | 5/1957 | Couse | 154/41 |
| 3,255,810 | | 6/1966 | Rowbottam . | |
| 3,296,056 | | 1/1967 | Bechtold | 156/461 |
| 3,341,013 | * | 9/1967 | Moulton | 160/371 |
| 3,373,546 | | 3/1968 | Setnan | 55/501 |
| 3,455,367 | * | 7/1969 | Le Tarte | 160/371 |
| 3,542,619 | | 11/1970 | McManus | 156/275 |
| 3,756,881 | | 9/1973 | Denman | 156/108 |
| 3,871,153 | | 3/1975 | Birum, Jr. | 52/624 |
| 4,161,977 | | 7/1979 | Baslow | 160/381 |
| 4,183,986 | | 1/1980 | Blaetterlein | 428/160 |
| 4,189,880 | | 2/1980 | Ballin | 52/202 |
| 4,197,686 | | 4/1980 | Baslow | 52/273 |
| 4,248,657 | | 2/1981 | Henry | 156/443 |
| 4,568,455 | | 2/1986 | Huber et al. | 209/405 |
| 4,635,418 | | 1/1987 | Hobgood | 52/239 |
| 4,663,231 | | 5/1987 | Girgis et al. | 428/378 |
| 4,675,065 | | 6/1987 | Gordon | 156/272.8 |
| 4,684,425 | | 8/1987 | Bannister | 156/216 |
| 4,741,797 | | 5/1988 | Henderson et al. | 156/479 |
| 4,851,070 | | 7/1989 | Shimada | 156/293 |
| 4,949,518 | | 8/1990 | Nagel et al. | 52/239 |
| 4,968,366 | | 11/1990 | Hukki et al. | 156/153 |
| 5,032,210 | | 7/1991 | Hukki et al. | 156/359 |
| 5,039,246 | | 8/1991 | Woodruff et al. | 403/24 |
| 5,090,469 | | 2/1992 | Boulanger | 160/368.1 |
| 5,137,622 | | 8/1992 | Souter | 209/403 |
| 5,238,515 | | 8/1993 | Insalaco et al. | 156/201 |
| 5,407,522 | | 4/1995 | Insalaco et al. | 156/465 |

(List continued on next page.)

FOREIGN PATENT DOCUMENTS

| | | |
|---|---|---|
| 1157765 | 11/1963 | (DE) . |
| 34467292 | 3/1986 | (DE) . |
| 29701908 | 5/1997 | (DE) . |
| 2630037 | 10/1989 | (FR) . |
| 711429 | 6/1954 | (GB) . |
| 63-137828 | 6/1988 | (JP) . |
| 04306392 | 10/1992 | (JP) . |
| 04166590 | 12/1992 | (JP) . |

*Primary Examiner*—Blair M. Johnson
(74) *Attorney, Agent, or Firm*—Duane Morris & Heckscher LLP

(57) ABSTRACT

A screen bar segment for use in forming a screen and frame assembly in which screen can be adhesively secured to the frame. The screen bar segment includes a tensioning step along one side thereof and adhesive applied along the base of the tensioning step, in an amount to provide a layer having a thickness between about 0.0005 to about 0.250 inches. The adhesive is selected from the group consisting of hot melt adhesives and thermoplastic resins having a heat resistance temperature of not less than about 35° C. and a viscosity of at most about 5000 poise at about 200° C. The screen bar segment can be used in a screen and frame assembly in which screen is adhesively secured to a screen frame. Also disclosed are related methods of making a screen bar and adhesive assembly, adhesively securing screen to screen bar segments of a screen frame and making a screen and frame assembly in which screen is adhesively secured to a screen frame.

35 Claims, 2 Drawing Sheets

U.S. PATENT DOCUMENTS

| | | | |
|---|---|---|---|
| 5,689,924 | 11/1997 | Mason | 52/239 |
| 5,718,791 | 2/1998 | Spengler | 156/212 |
| 5,775,400 | 7/1998 | Wilkinson | 160/323.1 |
| 5,783,137 | 7/1998 | Porta | 264/510 |
| 5,787,657 | 8/1998 | Librande et al. | 52/202 |
| 5,794,328 | 8/1998 | Simone | 29/709 |
| 5,794,528 | 8/1998 | Gronig et al. | 101/127.1 |
| 5,797,223 | 8/1998 | Shoup et al. | 52/204.1 |
| 5,806,549 | 9/1998 | Love | 135/143 |
| 5,816,279 | 10/1998 | Zheng | 135/126 |
| 5,816,954 | 10/1998 | Zheng | 473/471 |
| 5,819,651 | 10/1998 | Zepic et al. | 101/127.1 |
| 6,032,454 | 3/2000 | Damour et al. | 57/904 |

* cited by examiner

SCREEN AND FRAME ASSEMBLY IN WHICH THE SCREEN IS ADHESIVELY SECURED TO THE FRAME

BACKGROUND OF THE INVENTION

1. Field of the Invention

The present invention relates to a screen and frame assembly for windows, doors and the like in which the screen is adhesively secured to the frame, and methods of manufacturing such products. In particular, this invention relates to screen and frame assemblies suitable for windows, doors, operable skylights and the like, for use in residential and commercial buildings.

2. Description of the Related Art

The general purpose of screens (also called "bug," "fly," or "insect" screens) is to eliminate the ingress of insects, while providing ventilation. A typical screen assembly is made up of screen cloth, fabric, or mesh attached to a screen frame in a manner discussed in more detail below. For brevity, the term "screen" will be used hereafter, and includes such screen cloth, fabric, mesh or similar ventilation material.

Screen frames for windows, doors, operable skylights and the like are commonly made of four elongated frame members, called screen bars, of uniform cross section. These bars are typically roll-formed from aluminum or sheet steel, although some may be extruded aluminum. (Plastic and wood are also used, but to a lesser extent.) These screen bars are supplied from the screen bar manufacturer in lineal form and are cut to a final length by the screen assembly manufacturer. Further, these screen bars are held together at the corners with plastic or metal inserts, called corner keys, to form the screen frame.

Different style corner keys are available and are designed to match the particular screen bar used. The most popular corner key allows the screen bar to be cut straight at 90° at the ends. These keys typically are made from injection molded plastic and have a square block body to visibly fill the corner area of the frame. Attached to the body are insertion prongs that are pushed into the hollow screen bar profile to create friction fit connections. Corner keys requiring a 45° miter cut on the ends of the screen bar also can be used. These keys, usually metal, are less expensive and entirely hidden inside the screen bar. These keys also provide a friction fit connection.

Screen is then affixed to the screen frame, in a manner discussed below, to form a screen and frame assembly. These assemblies are then removably secured to windows, doors (e.g., patio screen doors), operable skylights, and the like. Screen and frame assemblies for such openings are very similar, often differing only in size. Accordingly, for brevity, screen and frame assemblies for windows will be discussed hereafter. Nevertheless, it will be understood that this discussion applies equally to screen and frame assemblies for doors, operable skylights and the like.

The use of a removable screen and frame assembly in window openings facilitates cleaning of the window panes, as well as the screen itself. A removable assembly also facilitates the replacement of the screen in the event that it becomes torn or ripped. For these applications, the screen is light weight, and is, therefore, susceptible to being damaged by children, pets and household mishaps. Replacement also is necessary after the screen has excessively weathered. This can occur when the screen is exposed to extreme weather conditions for extended periods.

It is desirable that the screen be a light weight fabric or mesh, and stretched taut across the screen frame to avoid unsightly sag and to allow a viewer to see through the screen with minimal visual interference. However, if the screen is tensioned excessively, the screen bars will deform inwardly in an hourglass shape. This resultant shape not only is aesthetically undesirable, but also can prevent proper installation in the window opening. Excess screen tension also increases the risk of tearing the screen during manufacture of the screen and frame assembly or while the assembly is in service.

Typically, the screen is fiberglass yarn or roving, which is coated, for example, with polyvinyl chloride (PVC), woven and heat fused. The next most popular form of screen is made by weaving drawn aluminum wire, which is subsequently painted. The PVC coated fiberglass screen is the most popular type, by approximately a 4 to 1 ratio in area. However, both offer the desired attributes of suitable strength and an open weave.

To compensate for deformation of the screen frame into the hourglass shape discussed above, generally the screen bars are manufactured with an outward bow before the screen is installed. After the screen is installed, its final tension straightens the frame members in the final assembly. This "pre-bow" is set into the screen bar during the extrusion or roll-forming process to make the screen bar lineal.

Typically, roll-formed bar has approximately 20 millimeters (0.75 inches) of bow over a 3.7 meter (12 feet) length. Additional bow is usually set by hand into the roll-formed bar prior to screen installation when the length of the frame members is greater than 1 meter (approximately 3.5 feet). Pre-bowing is not required, however, when the screen bar is sufficiently rigid to resist deformation caused by the resultant screen tension.

It is the current practice, essentially industry-wide, to secure screen in open grooves formed along inside edges of the screen frames using a stuffer strip known as "spline" and its associated fastening techniques. The open grooves are known as "spline grooves." Spline is often a wire-like, extruded rigid plastic or foam material, although some spline is made from metal, especially for use with aluminum screen. Spline is usually round or T-shaped in cross section, but can be U-shaped, for example.

U.S. Pat. No. 5,039,246 shows a conventional method of securing screen to a frame member using spline. FIGS. 1A and 1B of this application generally correspond to FIGS. 3 and 2, respectively, in that patent. Spline 58 is forced into spline groove or recess 56 in the screen bar 20, with the screen 22 sandwiched between the spline 58 and the spline groove 56. The screen 22 is held by friction between the spline 58 and the spline groove 56 with the resulting interference fit. A lip 50 and a ledge 52, part way down one side of the groove wall, are typically included to help trap and improve the strength in retaining the screen 22. The spline 58 and trapped screen 22 are forced into the groove 56, usually by hand, with the use of a roller device 70, including a roller 72, as shown in FIG. 1A. The term, "hand wiring", is used to describe the action of securing the screen 22 with spline 58 into the spline groove 56. Many attempts have been made to automate the installation of spline by machine. However, this automation has proven to be very difficult and machines of this nature have not been widely accepted as a viable option to hand wiring.

The conventional procedure for manufacturing and hand wiring a screen and frame assembly will be discussed in more detail below. First, the screen bars are cut to length, accounting for the corner key dimensions. Then, the screen frame is assembled using the cut screen bars and corner keys. As discussed above, when light construction screen bars are used, as is normally the case, a balance between pre-bow and screen tension is necessary to ensure straight screen bars and desirable tension in the final assembly. When the screen bar has insufficient pre-bow, the bars are deformed by hand a sufficient degree after the corner keys have been inserted. As discussed above, the amount of pre-bow is determined based on experience, but is typically a few millimeters of bow per meter length of the screen bar.

The screen frame is then secured to a table using locator (stop) blocks, which prevent shifting and maintain the frame square during screen installation. The table typically has permanent stop blocks for orienting the screen frame. To maintain the pre-bow, removable blocks are pushed against the center portions of the screen bars and then fastened to the table. (The spline groove must be facing up and unobstructed by the blocks.) More elaborate tables use removable blocks arranged in grooves cut into the table, with the removable blocks being secured by integral friction clamps.

After the screen frame is secured to the table, screen is pulled from a roll and positioned to cover the opening formed by the frame. Ideally, no excess screen is used. However, some manufacturers prefer to position the screen approximately two inches wider than the frame width, so that the screen is pulled past the end of the frame by approximately one inch to ensure that sufficient screen can be rolled into the spline groove along the frame perimeter. In either technique, the screen is positioned over, with edges parallel to, the secured screen frame.

The screen and spline are installed into the spline groove by starting in one of the frame corners. The screen is then stretched taut at the next corner with one hand, keeping it straight and parallel to the edge of the mating screen bar. The spline is simultaneously held above the groove in the same manner as the screen, with the same hand. With the other hand, the installation roller is pushed along towards the upcoming corner with a firm downward force to push the spline and trap the screen into the spline groove. This action is repeated on the second and third screen bars. On the last screen bar, most of the tension is set into the screen. On this leg, the screen is pushed into the screen bar with the installer's finger, just prior to the insertion of the spline. This pre-insertion technique reduces the final tension in the screen to the desired level. The spline is cut at the final corner with a utility knife.

After the spline and screen are inserted in all screen bars, excess screen around the edge of the frame is cut away with a utility knife. To do this, the point of the blade is pushed against the screen bar, through the screen, immediately adjacent to the spline groove around the outside edge of the screen bar. Care must be taken to cut the screen close to the spline groove without cutting the screen covering the opening formed by the frame. The finished screen and frame assembly is removed from the table, inspected, and any necessary hardware is attached.

The current hand wiring process using spline has several drawbacks, however, as will be discussed in more detail below.

Current standards for screen and frame assemblies are established by associations such as the Screen Manufacturers Association (ANSI-SMA SMT 31-1990) in the United States and the General Standards Board in Canada (CAN-CGSB-79.1-M91). These standards cover particular elements of screen and frame assemblies for windows, patio doors and the like. For example, these standards set forth tolerances in terms of the strength of the screen, the strength required to fasten the screen to the screen bar, the amount of sag in the screen, etc. Although these standards generally can be met by using the spline technology discussed above, very close and consistent dimensional tolerances are required between the spline and the spline groove, respectively, in order to achieve the specified fastening strength. These tolerances require close attention and skill with current screen bar roll-forming and extrusion technology and current spline hand wiring techniques. Any out-of-tolerance spline and screen bar produced costs the manufacturer in wasted time, material and good will.

Further, the amount of force required by an installer to secure the screen with the spline in the spline groove may be high enough to cause repetitive strain injury, e.g., carpal tunnel syndrome, to one who routinely performs this job. This is of major importance, since this type of injury is serious and has recently received heightened public awareness. Further, such an injury to an installer is also costly to the manufacturer in terms of compensation and loss of skilled labor.

Also, the hand wiring technique is particularly difficult and time-consuming. Notably, it is difficult to control the wire-like spline material and simultaneously control the screen tension with one hand, while the spline is rolled in with the other hand. This operation requires a high degree of skill and careful attention. This adds to the final manufacturing cost, and, hence, increases the final cost to the consumer.

Quality control also has become an issue with current spline techniques. Specifically, installers have learned ways to make their jobs easier, to the detriment of quality control. This is particularly true when using PVC spline. For example, an installer will stretch the PVC spline just prior to insertion, in order to reduce the diameter of the spline. This, of course, makes it easier to install. However, this also reduces the "pull-out" force or attachment strength of the spline and screen. The result is that the screen can be more easily pulled out from the spline groove, which is undesirable. (This, however, is not an issue with polyethylene spline, which does not stretch in the manner of PVC spline.)

There are other drawbacks associated with conventional spline techniques. In particular, the use of a separate fastening device (i.e., spline) requires separate inventory control and associated costs. Screen manufacturers prefer to minimize inventory. Therefore, it is desirable to eliminate spline as a separate item. Also, the need to have a strong interference fit in securing the spline necessitates stiff walls on the spline groove. By eliminating the need for an interference fit, the gauge of the aluminum or steel of the screen frame can be reduced substantially. This will reduce costs. Further, the spline technology makes the design of automatic assembly equipment extremely complex.

For the foregoing reasons, a need has arisen to provide a screen and frame assembly that eliminates the spline technology. An additional need has arisen to manufacture such products more easily.

Some attempts have been made in the art to provide screen and frame assemblies without traditional spline. For example, in U.S. Pat. No. 3,255,810, a heated iron is placed in contact with screen laid across a fusible material. One or both of the screen and the fusible, spline-like material are fused into engagement. In U.S. Pat. No. 4,568,455, the bonding of screen to a thermoplastic frame is accomplished by resistance heating of the screen using an electrical potential of four volts and a current of approximately 2200 amps, which is applied for approximately forty-eight seconds, to fuse the thermoplastic. This method, however, requires external tensioning until the thermoplastic cools and solidifies.

In another aspect, U.S. Pat. No. 4,968,366 teaches a complex method of manufacturing tension screens using an apparatus that includes a screen tensioning frame and a platform positioned adjacent to tensioned screen. The platform includes heating elements about the periphery of a sheet heater. The heating elements receive a screen frame which can be lifted into contact with screen in the tensioning frame. The sheet heater approaches the screen itself in order to heat an adhesive to bond the screen to the screen frame. A thermal control cycle allows the screen frame to cool prior to the tensioned screen being cooled. Blowers enhance this cooling. A resilient device maintains tension in the screen irrespective of heat expansion and maintains a uniform pressure of the peripheral heating elements against the screen frame and, in turn, against the screen. Thus, in this arrangement, it is necessary to heat the entire mating surfaces, while the screen is maintained under high tension. This complex technique requires high manufacturing precision, including proper tensioning of the screen and mating of the heating elements and the tensioning frame. Further, this technique is too slow and cumbersome to be considered practical for the manufacture of screen and frame assemblies for windows and the like.

Other techniques, in general, are known to fuse screening material to frames. However, these techniques are far afield from this invention. For example, U.S. Pat. No. 4,675,065 (the '065 patent) shows a method for securing a microsieve to a support member. A laser beam is directed against a point on the upper edge of a well which contains the microsieve to melt fusible material in contact with the laser beam. The laser-melted fusible material travels down the well wall, contacts the edge of the microsieve and solidifies to secure the microsieve. Japanese patent document No. 63-137828 (the '828 document) shows a single step method of ultrasonically welding screening net to the bottom of a small, cylindrical container using resin and a single, vibrating tip, which is identical in size to the container bottom. One having ordinary skill in the art will readily appreciate that the use of a laser beam or ultrasonic welding, in general, can be used within the concepts of the invention discussed below. However, the exotic techniques for the small parts, as disclosed in the '065 patent and the '828 document, are limited to their particular applications, which are unrelated to this invention.

Accordingly, a need has arisen for a screen and frame assembly for windows, doors and the like in which the screen is adhesively secured to the frame in the manner of this invention. There is also a need for methods of making such products as discussed herein.

SUMMARY OF THE INVENTION

An object of this invention is to address the foregoing needs in the art and to provide a screen and frame assembly for windows, doors and the like, in which the screen is adhesively secured to the frame.

Another object of this invention is to eliminate the difficulties and shortcomings associated with the spline technology. Therefore, a related object of this invention is to provide a method of making a screen and frame assembly in which the screen is adhesively secured to the frame, which eliminates the use of spline altogether.

A further object of this invention is to reduce the level of skill and time, as well as the insertion (muscular) force, required to attach screen to screen bar of a screen frame.

Still another object of this invention is to provide a simple method of attaching screen to screen bar of a screen frame, and to provide improved methods of making screen and frame assemblies.

Yet another object of this invention is to provide the ability to automate the method of making the screen and frame assembly of this invention.

In one aspect, the present invention provides a screen bar for use in forming a screen and frame assembly in which screen can be adhesively secured to the screen bar. The screen bar includes a screen bar segment having a tensioning step along one side thereof and adhesive applied along the base of the tensioning step of the screen bar. The adhesive can be applied as a film or a bead.

In another aspect, the present invention provides a screen and frame assembly in which screen is adhesively secured to a screen frame. The assembly includes a plurality of segments of screen bar secured together to form the screen frame, each of the plurality of screen bar segments including a tensioning step along one side thereof, adhesive being applied along the base of the tensioning step of each of the screen bar segments and screen spread across the screen frame, tensioned and secured by the adhesive to the base of tensioning step for each of the plurality of screen bar segments. In a preferred embodiment, the adhesive encapsulates strands of the screen to secure the screen to the bottom of the tensioning step.

In yet another aspect, the present invention provides a method of making a screen bar and adhesive assembly for use in making a screen and frame assembly in which screen can be adhesively secured to the screen bar. The method includes (i) making a screen bar segment; (ii) forming a tensioning step along one side of the screen bar segment and (iii) applying adhesive along the base of the tensioning step of the screen bar segment. The product made by this method can be stored for later use. The screen bar segment can be made from metal, plastic, composites, wood and the like. In the case of metal, the screen bar segment can be made by either roll-forming or extruding metal into the desired shape. In the case of plastic, the screen bar segment can be made by extrusion.

In still another aspect, the present invention provides a method of adhesively securing screen to screen bar segments of a screen frame. The method includes steps of (i) providing a screen frame comprised of segments of screen bar, each of the screen bar segments having a tensioning step along one side thereof, with adhesive applied along the base of the tensioning step of the screen bar segments, (ii) spreading screen across the frame such that the screen passes over the tensioning steps of the screen bar segments of the frame, (iii) applying localized pressure to the screen, to tension the screen against a localized area of one of the tensioning steps, while simultaneously heating the adhesive in the localized area such that the adhesive melts, flows, and bonds to strands of the screen in the localized area and then cools as heating in the localized area is removed, to secure the screen to the screen bar segments in the localized area and (iv) repeating step (iii), in a progressive manner, for the screen along each of the screen bar segments in the frame, to adhesively secure the screen to each of the screen bar segments of the screen frame. If desired, the rate of cooling of the adhesive in step (iii) can be augmented with external cooling devices.

In yet another aspect, the present invention provides a method of making a screen and frame assembly in which screen is adhesively secured to a screen frame. The method includes steps of (i) making segments of screen bar, (ii) forming a tensioning step along one side of each screen bar segment, (iii) applying adhesive along the base of the tensioning step of each screen bar segment, (iv) forming the segments of the screen bar into a frame, (v) spreading screen across the frame such that the screen passes over the tensioning steps of the screen bar segments of the frame, (vi) applying localized pressure to the screen, to tension the screen against a localized area of one of the tensioning steps, while simultaneously heating the adhesive in the localized area such that the adhesive melts, flows, and bonds to strands of the screen in the localized area, and then cools and solidifies as heating in the localized area is removed, to secure the screen to the screen bar segments in the localized area, and (vii) repeating step (vi), in a progressive manner, for the screen along each of the screen bar segments in the frame to make a screen and frame assembly in which screen is adhesively secured to the screen frame. If desired, the rate of cooling of the adhesive in step (vi) can be augmented with external cooling devices. The screen bar segment can be made from metal, plastic, composites, wood and the like. In the case of metal, the screen bar segment can be made by either roll-forming or extruding metal into the desired shape. In the case of plastic, the screen bar segment can be made by extrusion.

In still another aspect, the present invention provides a method of adhesively securing screen to screen bar segments of a screen frame. The method includes steps of (i) providing a screen frame comprised of segments of screen bar, each of the screen bar segments having a tensioning step along one side thereof, with adhesive being applied along the base of the tensioning step of the screen bar segments, (ii) heating the adhesive in a respective screen bar segment to a temperature sufficient to melt, (iii) spreading screen across the frame such that the screen passes over the tensioning step of the respective screen bar segment, (iv) applying localized pressure to the screen, to tension the screen against a localized area of the tensioning step of the respective screen bar segment, while simultaneously cooling the adhesive in the localized area such that the melted adhesive flows and bonds to the strands of the screen in the localized area, to secure the screen to the screen bar segments in the localized area and (v) repeating step (iv), in a progressive manner, for the screen along each of the screen bar segments in the frame, to adhesively secure the screen to the screen bar segments of the screen frame.

In still another aspect, the present invention provides a method of making a screen and frame assembly in which screen is adhesively secured to a screen frame. The method includes steps of (i) making segments of screen bar; (ii) forming a tensioning step along one side of each screen bar segment, (iii) applying adhesive along the base of the tensioning step of each screen bar segment, (iv) forming the segments of the screen bar into a frame, (v) heating the adhesive in a respective screen bar segment to a temperature sufficient to melt, (vi) spreading screen across the frame such that the screen passes over the tensioning step of the respective screen bar segment, (vii) applying localized pressure to the screen, to tension the screen against a localized area of the tensioning step of the respective screen bar segment, while simultaneously cooling the adhesive in the localized area such that the melted adhesive flows and bonds to the strands of the screen in the localized area, to secure the screen to the screen bar segments in the localized area, and (viii) repeating step (vii), in a progressive manner, for the screen along each of the screen bar segments in the frame, to adhesively secure the screen to the screen bar segments of the screen frame. The screen bar segment can be made from metal, plastic, composites, wood and the like. In the case of metal, the screen bar segment can be made by either roll-forming or extruding metal into the desired shape. In the case of plastic, the screen bar can be made by extrusion.

In this invention, the tensioning step can be provided by a conventional spline groove and the like, or by a step, lip or wall, for example. Also, the adhesive is applied along the base of the tensioning step of each screen bar segment in an amount to provide a layer having a thickness between about 0.0005 to about 0.250 inches and is selected from the group consisting of hot melt adhesives and thermoplastic resins having a heat resistance temperature of not less than about 35° C. and a viscosity of at most about 5000 poise at about 200° C. In one aspect, the adhesive is a hot melt adhesive selected from the group consisting of polyester, polyamide, polyolefin, polypropylene, polyurethane, butyl and ethylene vinyl acetate based adhesives. This includes adhesives in foamed and non-foamed states.

I prefer that the adhesive have a heat resistance temperature between about 55° C. and about 180° C. and a viscosity of at most about 1200 poise at about 200° C. It is more preferred that the adhesive have a heat resistance temperature between about 85° C. and about 150° C. and a viscosity of at most about 1000 poise at about 200° C. It is most preferred that the adhesive have a heat resistance temperature between about 100° C. and about 130° C. and a viscosity of at most about 1000 poise at about 200° C. In these ranges, the heat resistance temperature is the determining factor. Therefore, an adhesive having the desired heat resistance temperature, but a viscosity outside of the desired range, would still be preferred.

In one aspect, I prefer to apply the adhesive to the screen bar as a film to provide a layer having a thickness between about 0.003 to about 0.020 inches. In another aspect, I prefer to apply the adhesive as a bead to provide a layer having a thickness between about 0.020 to about 0.250 inches. When the adhesive is applied as a bead, it is more preferred that the thickness be between about 0.030 to about 0.150 inches, and most preferred that the thickness be between about 0.050 to about 0.100 inches. In these ranges, I have found that the bead of adhesive is sufficient to encapsulate strands of the screen, which is preferable, but not necessary, in this invention.

The foregoing and other objects, aspects, features and advantages of the present invention will become apparent from the following detailed description of the preferred embodiments.

BRIEF DESCRIPTION OF THE DRAWINGS

Like reference numerals have been used for like or similar elements throughout the views.

DETAILED DESCRIPTION OF THE PREFERRED EMBODIMENTS

Figure 2A:
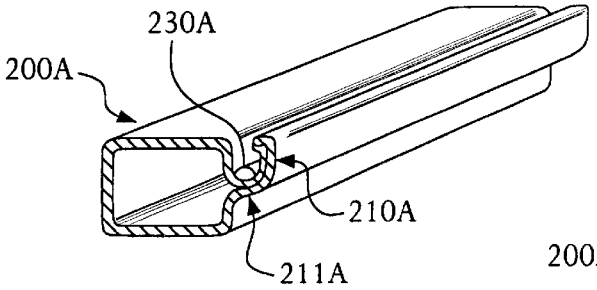
FIG. 2A shows a cross-sectional view of a first type of screen bar of this invention for use in forming a screen and frame assembly in which screen can be adhesively secured to a tensioning step provided, in this example, by a groove of the screen bar.

FIG. 2A shows a cross-sectional view of a segment of a first type of screen bar 200A for use in forming a screen and frame assembly in which screen can be adhesively secured to the screen frame. FIG. 2A shows that the segment of screen bar 200A includes a tensioning step 210A provided by a groove 211A along one side thereof. Adhesive 230A is applied along the base of the tensioning step 210A, in the groove 211A of the screen bar 200A. Therefore, as shown in FIG. 2A, the adhesive is secured to the screen bar 200A at the base of the groove 211A.

Figure 2B:
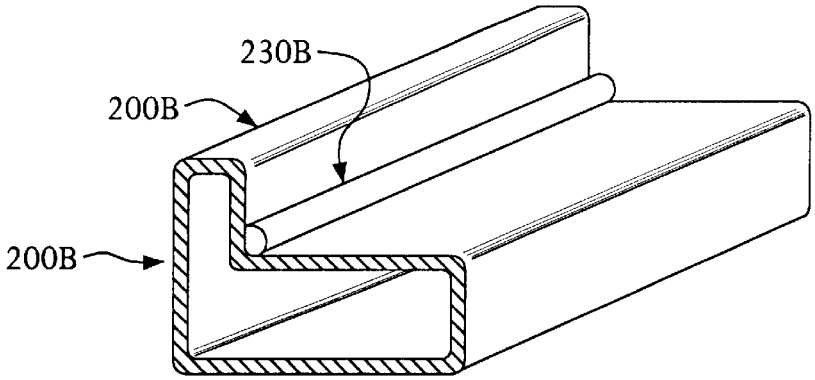
FIG. 2B shows a cross-sectional view of a second type of screen bar of this invention for use in forming a screen and frame assembly in which screen can be adhesively secured to a tensioning step of the screen bar.

FIG. 2B shows a cross-sectional view of a segment of a second type of screen bar 200B for use in forming a screen and frame assembly in which screen can be adhesively secured to the screen bar. FIG. 2B shows that the segment of screen bar 200B includes a step, lip or wall (hereafter, called a "step") 210B along one side thereof. Adhesive 230B is applied along the base of the step 210B of the screen bar 200B. In this embodiment, since the base of the step 210B has a relatively sharp angle, the adhesive can be applied against the base of the step 210B. Therefore, as shown in FIG. 2B, the adhesive 230B is secured to the screen bar 200B along and adjacent to the step 210B.

In the embodiments shown in FIG. 2A or 2B, a tensioning step can be provided by a conventional spline groove and the like, or by a step, lip, or wall, for example, as desired. These and their equivalents will collectively be referred to as a "tensioning step" hereafter, for ease of discussion. This tensioning step will be discussed in more detail below.

Parenthetically, a groove is preferred over a step, lip or wall, since it provides better control in setting screen tension and is aesthetically more pleasing because the adhesive and the edge of the screen are hidden from view. A groove also protects the adhesive bond area from weather and ultraviolet radiation from the sun, to some degree. A groove also is preferred since it provides the homeowner or installer with an option to replace the screen, if desired, using a conventional spline technique, in the event replacement is necessary.

Adhesive is applied in the groove 211A of the screen bar 200A or against the base of the step 210B of the screen bar 200B. In either case, the adhesive is applied along the base of the respective tensioning step. As will be discussed below, the adhesive can be applied as a film or bead. The particular amounts and types of adhesives also will be discussed in more detail below.

As discussed above, in either the embodiment shown in FIG. 2A or that shown in FIG. 2B, the adhesive is secured to the screen bar along the base of the respective tensioning step. The term "secured" or the term "bonded" as used herein is intended to include the generally accepted terms for adhesion of one material to another, i.e., mechanical interlocking, the formation of direct chemical bonds across the interface of the materials and electrostatic attraction, as discussed in Engineered Materials Handbook, Vol. 3, "Fundamentals of Adhesives and Sealants Technology", ASM International Handbook Committee, page 40. By far, the dominating adhesion mechanism, especially in the absence of reactive groups, is the electrostatic attraction of the adhesive to the screen bar as the adherend and vice versa. These are primarily dispersion forces (London forces) and forces arising from the interaction of permanent dipoles. These forces provide much of the attraction between the adhesive and adherend and contribute significantly to the cohesive strength of the adhesive polymer. Mechanical interlocking is assisted by the roughness and porosity of the adherend, in this case, the screen bar. The formation of covalent chemical bonds requires that there be mutually reactive chemical groups tightly bound on the adherend surf ace and in the adhesive.

This invention also relates to a method of making a screen bar and adhesive assembly for use in making a screen and frame assembly in which screen can be adhesively secured to a screen frame. In this method, I prefer to apply the adhesive while the screen bar 200A or 200B is being made. The screen bar can be made from metal, plastic, composites, wood and the like. By way of example, the screen bar 200A or 200B can be made by either roll-forming or extruding metal (or by extruding plastic) into a segment of screen bar 200A or 200B and forming the tensioning step by groove 211A or by step 210B along one side of the screen bar segment. Equivalent methods are used for other materials. At this time, adhesive 230A or 230B is applied in the groove 211A of the segment of screen bar 200A or along the base of the step 210B of the segment of screen bar 200B. However, if desired, the adhesive also can be applied off-line in an operation subsequent to the manufacture of the segment of screen bar 200A or 200B.

During roll-forming, for example, the adhesive can be applied to the flat strip, before it passes through the rollers of the roll former, or, preferably, at or near the exit end after the screen bar has been shaped. I prefer not to apply the adhesive to the flat strip, however, because the adhesive must be allowed to cool before roll-forming, which takes time and space and it is more difficult to position the film or bead of adhesive correctly. In the case of extruded screen bar, the adhesive can only be applied after the screen bar has been formed.

In each of the above cases, adhesive is applied to the screen bar using a standard hot melt adhesive applicator utilizing a bulk melter and a constant displacement pump or the like. Alternatively, a single screw extruder can be used for this application. As discussed in more detail below, either a film or a bead of adhesive having a desired thickness can be applied. For both types of applications (bulk melter or extruder), the hot melt adhesive (in bulk, pellet or granular form) is heated above the melting point and pushed through a small orifice (nozzle) to stream into the groove 211A of the screen bar or along the base of the step 210B of the screen bar (or to its final location, if applied onto the flat strip before the strip is roll-formed), which is driven under the nozzle at a constant speed. The molten adhesive is allowed to cool to room temperature, and the finished screen bar with applied adhesive can then be stored. Typically, roll-forming lines run at a speed between 100 and 400 feet per minute and slightly less for aluminum extrusion. Off-line application typically runs at 100 to 300 feet per minute. By way of example, the application of a 0.100 inch diameter bead of adhesive having a specific gravity of 1.02 (typical for polyamide) will need to be supplied at 16 pounds per hour to meet a 100 feet per minute line speed and 48 pounds per hour for a 300 feet per minute line speed.

I have found that by preheating the screen bar just prior to application of the adhesive, to between about 40 and about 150° C. greatly improves the adhesion between the adhesive and the screen bar. Flame treatment of the surface of the screen bar also improves this adhesion. Therefore, when applying the adhesive, I prefer to heat the screen bar at the location of adhesive application. Heating the side of the screen bar that the adhesive will contact significantly lowers the viscosity of the adhesive and allows it to flow easily at the heated interface. I have found that this provides a mechanical bond (interlocking) on a microscopic scale, in that the adhesive flows into any minute imperfections in the screen bar, as well as an electrostatic bond. I prefer to heat the screen bar to a temperature in the range of about 40 to about 150° C., with about 60 to about 120° C. being preferred and about 60 to about 100° C. being most preferred. A propane flame or like heating element can be used to heat the screen bar in this manner. Corona treating, as is routinely used in the plastic and adhesive industry may also improve bond strength, depending upon the substrate.

Mechanical bonding also can be effected by perforating the bottom of the groove or the bottom of the screen bar adjacent to the step or lip. When applied, the low viscosity adhesive will flow through these openings to some extent and form rivet-shaped beads or heads on the underside of the screen bar. When solidified, these beads mechanically lock the screen to the screen bar. These openings may be on the order of 1/16" round or square. Of course, this dimension can be varied as desired.

The adhesive is allowed to cool and set in the groove 211A of the screen bar 200A or along the step 210B of screen bar 200B. Then, the segment of screen bar 200A or 200B, which includes the adhesive 230A or 230B, can be stored for any desired time period, and used at a later date. Typically, the screen bar and adhesive assembly is sold in a standard lineal format—typically 12 feet long. As discussed above with respect to the description of the related art, the lineals are cut to size and made into screen frames using corner keys or otherwise, in accordance with conventional practice.

As will be discussed below, an advantage provided by this invention is the re-melting characteristic of the adhesive used. Generally speaking, I prefer to use an adhesive that (1) is applied easily, in liquid (e.g., melted (preferred) or solvated) form, (2) solidifies after application to the screen bar (for storage, shipment, assembly of the screen frame, etc.) and then (3) can be re-melted or reactivated (liquified) during application of the screen to secure the screen to the screen frame, as will be discussed in more detail below.

The adhesive family known generally as "hot melt adhesives," as discussed herein in more detail, have been found to meet these requirements, since they can be applied in liquid form, solidify and then can be re-melted or "re-activated" at the time of securing the screen (i.e., screen assembly).

Hot melt adhesives in a solvated, liquid form, can also be used for this invention. They are liquified by the use of solvents such as toluene, MEK (methyl-ethyl-ketone), acetone, and the like. Once solvated, they are applied in liquid form and solidify upon solvent evaporation. They can then be re-melted in the same way the non-solvated forms are. The solvated forms, however, are less desirable, since the solvents add costs, and the evaporated solvents are typically toxic when inhaled.

The curable type of hot melt adhesives, known as "hot melt polyurethane adhesives" (i.e., PUR's or HMPUR's) can also be used for this invention, if the adhesive is activated (at the time of securing the screen) before it cures. The window of time available, between application to the screen bar and cure, depends upon the adhesive formulation. For instance, Henkel macromelt adhesive A4676 is a hot melt polyurethane adhesive which has approximately four days before it is cured to the point where reactivating cannot occur, effectively. Also available, with similar characteristics, is HL9527 available from European Pullers, Rangeview Road, Mississauga, Toronto, Ontario. Essentially, these adhesives react with the moisture in the air, causing permanent molecular crosslinking and thus become un-meltable (thermoset). The act of curing or cross-linking of the polyol and the isocyanate in these adhesives precludes the resultant polyurethane from remelting. The A4676 adhesive, for example, has an acceptable application melt temperature of 110° C. and a green strength (tensile strength, before cure) of 4 to 5 pounds per linear inch of screen which is more than adequate to secure the screen, once applied. The adhesive, upon curing, has a tensile strength of 2300 lb./in$^2$ (psi), a heat resistance temperature of 300° C. and a viscosity of 100 poise at 230° C. The advantage to this type of adhesive is the low application temperature and the relatively high heat resistance temperature, once cured. The disadvantage is the fact that the assembly must be completed shortly after the application of the adhesive to the screen bar. Thus, this type of adhesive has limited use. For the majority of applications, when the screen bar is stored for prolonged periods before screen assembly, the regular hot melt (non-curing type) adhesive must be used. For this reason, the regular hot melt type of adhesive is most preferred for this invention, as will be discussed in more detail below.

The use of B-stage epoxy adhesive was found to be not nearly as practical for this invention. They could be made to work if formulated to be applied in a high enough viscosity state to allow handling, once applied to the screen bar; to have a high enough tack or green strength to secure the screen before cure; and to have a long enough shelf life, once applied to the screen bar, to allow screen assembly in time before natural crosslinking occurs. All of these conditions, however, make these adhesives difficult to work with in this environment. Another major drawback with these adhesives is the need for a long cure time at elevated temperatures. Typically, this requires the use of an oven. High intensity lasers have been used to greatly speed up the cure time, but are considered impractical, from a cost perspective, for this invention.

This invention also provides a screen and frame assembly in which screen is adhesively secured to a screen frame. The assembly includes a plurality of segments of screen bar 200A or 200B, being secured together to form the screen frame. In one aspect, each of the plurality of screen bar segments 200A includes a tensioning step provided by a groove 211A along one side thereof. In another aspect, each of the plurality of screen bar segments 200B includes a step 210B along one side thereof. Adhesive 230A is applied in the groove 211A or adhesive 230B is applied along the step 210B of each of the screen bar segments. The particular amounts and types of adhesives will be discussed in more detail below.

This invention also provides a method of making a screen and frame assembly in which screen is adhesively secured to a screen frame and a method of adhesively securing screen to screen bar segments of a screen frame. As discussed above, segments of screen bar 200A or 200B are formed (e.g., when metal or plastic is used, by roll-forming or extrusion) and each have a tensioning step provided by a groove 211A or step 210B formed along one side of the respective screen bar segment. Adhesive 230A is applied in the groove 211A of each screen bar segment 200A. Alternatively, adhesive 230B is applied along the step 210B of each screen bar segment 200B. The segments of the screen bar 200A or 200B are formed into a frame using corner keys or other suitable fasteners.

Figure 4A:
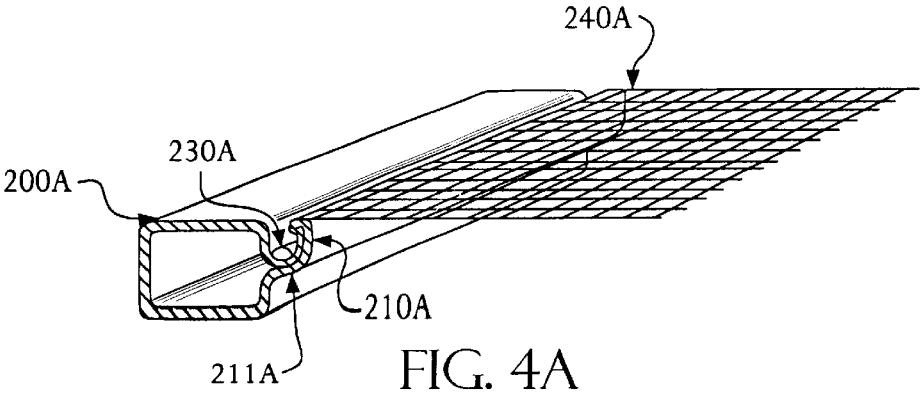
FIG. 4A shows a partial section of a screen and frame assembly in which the screen is adhesively secured to the tensioning step provided by the groove of the screen frame of the first type.
Figure 4B:
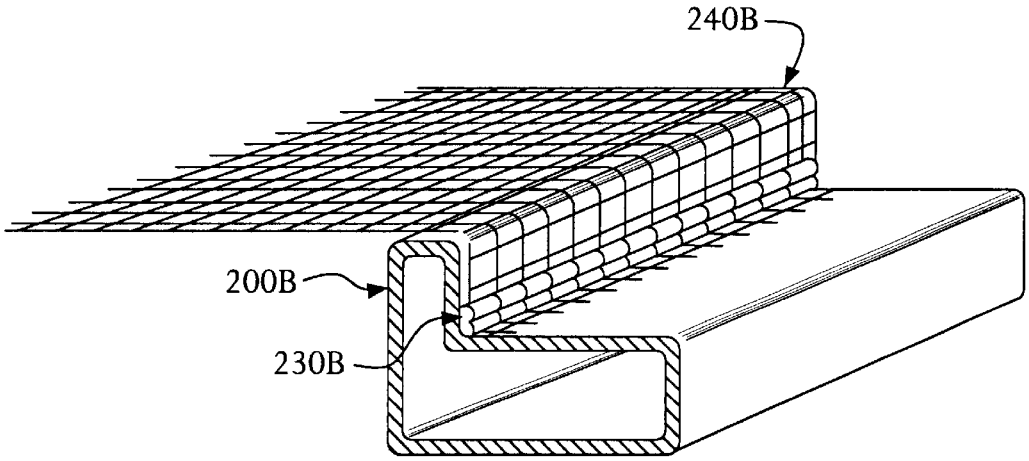
FIG. 4B shows a partial section of a screen and frame assembly in which the screen is adhesively secured to the tensioning step of the screen frame of the second type.

In one aspect, as shown in FIG. 4A, screen 240A is then spread across the frame such that the screen 240A is secured in the grooves 211A of the screen bar segments 200A of the frame. In another aspect, as shown in FIG. 4B, screen 240B is spread across the frame and secured at the base of the steps 210B of the screen bar segments 200B of the frame.

Figure 1A:
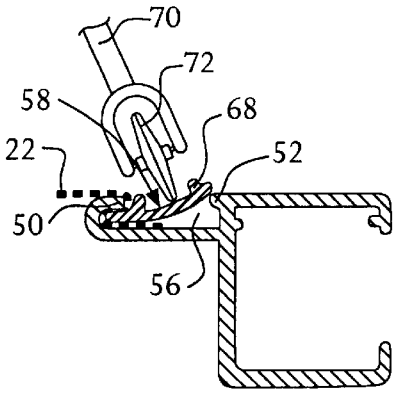
FIG. 1A PRIOR ART
FIG. 1A shows a cross-sectional view of a conventional method of installing screen into a screen frame using spline and a hand roller.
Figure 1B:
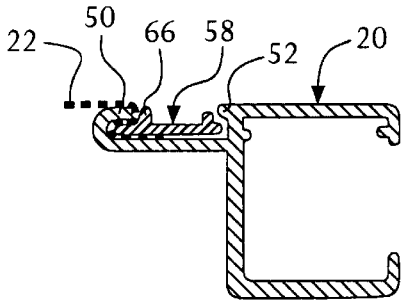
FIG. 1B PRIOR ART
FIG. 1B shows a cross-sectional view of screen installed into a screen frame using spline, as is conventional in the art.
Figure 3A:
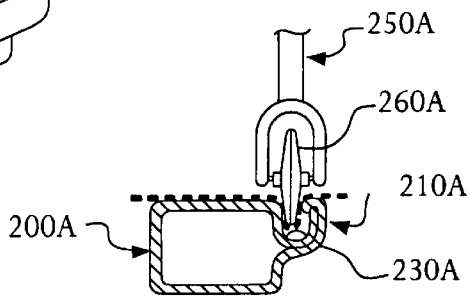
FIG. 3A shows a method of adhesively securing screen to a screen frame using a tensioning tool to heat or cool the adhesive and tension the screen to the tensioning step provided by the groove of the first type of screen bar.
Figure 3B:
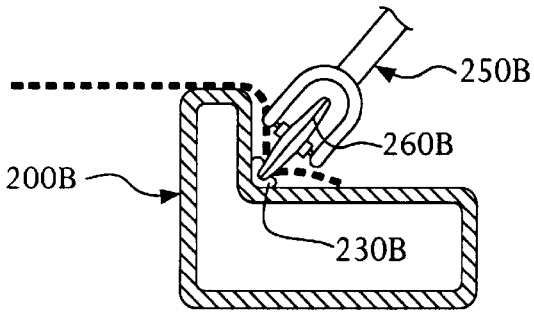
FIG. 3B shows a method of adhesively securing screen to a screen frame using a tensioning tool to heat or cool the adhesive and tension the screen against the tensioning step of the second type of screen bar.

In this invention, no spline is used to secure the screen. Rather, in one aspect of this invention, to secure the screen to the screen bar segments, a tensioning tool 250 (of the type shown in FIGS. 3A and 3B) is used in place of the spline insertion roller 70 discussed above with respect to FIG. 1A. In this embodiment, tensioning tool 250 includes a tensioning roller 260. In this embodiment, tensioning tool 250 also is a heating tool, in which tensioning roller 260 is a heated roller. Of course, other heating devices, such as an electrically heated sled, could be used. For example, in this embodiment, only one roller 260 is shown. However, a plurality of rollers, in series, could be used. Also, rollers need not be used at all. Rather, a heated knife edge, probe, contact or the like could be used. The heat for such a device could be generated in many ways. Further, equivalent techniques for securing the screen to the adhesive such as incremental ultrasonic welding, vibration heating hot air heating, infrared or microwave heating, and the like may likewise be used.

In this embodiment, the tensioning tool 250 (e.g., the heated tensioning roller 260) applies localized pressure to the screen, either to push the screen 240A into a localized area of one of the grooves 211A of the screen bar 200A to tension the screen 240A or to tension the screen 240B against a localized area of one of the steps 240B, while simultaneously heating the adhesive 230A or 230B in the localized area such that the adhesive 230A or 230B melts, flows, and bonds to the strands of the screen 240A or 240B in the localized area, and then cools as heating in the localized area is removed, to secure the screen 240A or 240B in the localized area. If desired, the rate of cooling of the adhesive can be augmented with external cooling devices. For example, forced cooling such as air cooling, or a liquid cooled sled could be used to assist the rate of cooling. Of course, this technique increases the complexity of the process, but it also increases the speed of the process.

Specifically, the tensioning tool 250 simultaneously pushes the screen cloth 240A into the adhesive 230A in groove 211A, or simultaneously pushes the screen cloth 240B against the adhesive 230B along the step 210B. The heat from the tensioning tool 250 melts the adhesive as the tool passes by and a slight downward pressure causes the adhesive to flow around the strands in the screen 240A or 240B. The action of pushing the screen 240A into the groove 211A or the screen 240B against the step 210B tensions the screen. If desired, a groove or recess (not shown) can be provided in the tensioning tool 250 to allow a space for molten adhesive to flow into and be distributed onto the strands of the screen. (If using a groove 211A, which is typically about 0.140 inches across, the tensioning tool 250 is typically about 0.100 inches wide, with a groove of appropriate dimensions.) Upon cooling, the adhesive solidifies and anchors and/or bonds to the screen 240A or 240B.

The speed of the pushing or rolling action must be slow enough to allow the surface of the adhesive or resin to be heated, liquify and flow around the strands of the screen, and to hold the screen under tension until the adhesive or resin has cooled and thus, solidified. Speed is dictated by the melting temperature of the adhesive, the temperature of the tensioning tool 250 and the dwell time during which heat is applied. Also a factor in dictating the speed is the effective length of the tensioning tool 250. The amount of force required to cause the adhesive or resin to flow around the strands of the screen is related to the flow characteristics of the adhesive or resin and the temperature of the tensioning tool 250. This amount of force is quite low in my invention. Generally, the higher the temperature of the tensioning tool 250, the faster the melting and flowing of the adhesive or resin, and thus, the faster the allowable forward pushing or roller speed. However, on the last frame member, where most screen tensioning occurs, the speed of the tensioning tool 250 must not exceed the rate at which the adhesive or resin cools and solidifies, since the tensioning tool 250 must not release tension until the cooling adhesive can hold the screen.

In manufacturing the screen and frame assembly, using one approach, in which adjacent sides are tensioned in a successive pattern around the perimeter of the frame, tensioning does not occur in the first two segments, but occurs to some degree on the third segment, with most of the tensioning occurring on the fourth segment (when a four sided frame is used and when these segments are completed successively). In some cases, such as when using some automatic equipment, tensioning occurs on opposite screen bar segments—such as tensioning on the third across from the first or the fourth across from the second. In either case, in this invention, a technique similar to that discussed above with respect to the spline technology can be utilized, in which the hot melt adhesive, for example, is heated past its melting point in order to wet and/or encapsulate the strands of the screen, while the screen is held under tension until the adhesive has cooled and solidified to complete the bond to fix the residual light tension to the screen.

I have found that an acceptable degree of bonding can occur without encapsulation of the strands of the screen into the adhesive. Therefore, encapsulation is not essential to this invention. It is, however, preferred to encapsulate the strands of the screen using the adhesive, since this results in mechanical bonding as well as adhesive bonding. Further, encapsulation allows visual assurance that full melting and bonding have occurred.

For straight adhesion, without encapsulation, the adhesive can be applied as a film in a layer having a thickness between about 0.0005 to about 0.020 inches, and preferably, between about 0.003 to about 0.020 inches. The film option, if deemed acceptable by users, has the advantage of faster application speed. Whether a film or a bead of adhesive is used is really a matter of the degree of bond certainty that is desired by the particular user. When using a bead of adhesive, I prefer to provide a layer having a thickness between about 0.020 to about 0.250 inches. When a bead is used, it is more preferred to apply the adhesive in an amount to provide a layer having a thickness between about 0.030 to about 0.150 inches. I have also found this amount to be sufficient to provide encapsulation.

An advantage of using a bead of adhesive in a groove (over a film of adhesive in a groove or along a bottom of a step or lip) is that the bead can be mechanically trapped by the walls of the groove, if the walls of the groove are tapered slightly to form a smaller spacing at the top (opening) than at the bottom.

The speed of securing the screen to the adhesive is of paramount importance to minimize assembly time and associated costs. The speed of the progressive action is limited by both the adhesive characteristics, as discussed above and the mechanisms of heating and cooling, which are dictated by the techniques and tool design used. Either the heating or the cooling stages can dictate speed, depending upon tool design (heating) and cooling conditions, as will be discussed below.

To maximize the tool speed, relative to the heating action, three parameters are important. The first is heat flux, which must be maximized. The second is the length of the heating surface, to increase heating dwell time as the tool passes over the adhesive. The third is the temperature rise required. These parameters are discussed in more detail below.

The rate of heat flux is directly proportional to the difference in temperature between the tool and the adhesive. Thus, it is important to have as high a tool temperature as possible to provide the greatest heat flux to melt the adhesive. I have found the upper limit on the tool temperature for the exemplary polyester and polyamide adhesives listed below to be around 500° C., since excessive smoke can occur above 500° C., especially for PVC screen. The acceptable tool temperature, then, is about 200° C. to about 500° C. with about 200° C. to about 400° C. being preferred, about 200° C. to about 300° C. being more preferred and about 250° C. to about 300° C. being most preferred, to achieve acceptable bonding at useful speeds, while minimizing the production of smoke.

The tool must be capable of continuously delivering high heat flux to the contact surface, as it is used to raise the temperature of the adhesive to the melt point (sensible) and then to melt the adhesive (latent heat) to a highly flowable state, as the tool progresses along. This heat delivery can be achieved by incorporating a large heat mass (storage) into the tool design and choosing highly conductive materials to flow heat from the mass to the contact surface. Brass, steel, and aluminum work well.

A brass tool body can be used as a thermal mass storage device combined with an aluminum outer ring to conduct the heat from the brass body to the contact surface quickly and continuously. The brass body of the tool can be heated externally to the desired temperature between uses and then used until it has cooled to the point where the roller speed is too low. In practice, I have found that a brass and aluminum roller, for example, heated by a propane gas flame to approximately 500° C. gave acceptable application speeds of approximately 4 to 5 inches per second. Continuous large screens could be "wired" with this method with the tool being heated between assembly operations. The tool was externally heated with a flame between uses (for example, while the edges of the screen were being trimmed and the next screen was being mounted). Other methods such as hot air, infrared, induction, and the like could also be used to heat the tool.

Although the thermal storage approach has been used successfully, it is preferred to have a tool, such as the heated sled discussed above, which is continuously heated electrically via internal heating elements, such as cartridge heaters, using thermocouple temperature control. This arrangement maintains the contact surface temperature to a close degree, improving overall process control and allowing a constant tool speed.

The heating dwell time can be increased at a given speed by increasing the length of the contact surface for a fixed tool (for example, two to five inches long) or by using multiple rollers, for example, on a single tool. A combination of a fixed heating section and heated rollers could also be used. I have found that drag is not an issue using a fixed sled design, as the molten adhesive acts effectively to lubricate the sliding action. This was found to be true for all adhesives discussed below in Tables 1 and 2. Hot air to heat the tool, or to heat the adhesive directly also could be used in place of, or in combination with, an electrically heated tool, as will be discussed in more detail below. A suitable hot air heater is an in-line heater made by Osram Sylvania utilizing a serpentine heat exchanger to give air temperatures in excess of 870° C. and 8000 watts of pin-point heating.

Heating rates can also be increased by preheating the screen bar and the adhesive therewith. In effect, the temperature rise of the adhesive when the tool passes is reduced, thus reducing the heating time to melt the adhesive. Preheating can be accomplished, for example, by mounting the screen frames to a heated surface prior to the wiring process or by preheating the entire screen frame in an oven. The highly conductive aluminum screen bar provides fast preheating in this manner. The practical limit in temperature is approximately 100° C., to ensure the plastic corners (usually polypropylene) do not soften. (For this reason, the plastic corners also should not be touched with the heated tool.) Preheating, thus described, may be attractive in some circumstances, but is not generally required, nor preferred, since it adds unnecessary complexity to the process and interferes with the cooling action, as discussed below.

In this aspect of the invention, the primary mode of cooling occurs by conduction of heat into the aluminum substrate (screen bar) and secondarily, by convection/conduction into the surrounding air. Although it is preferred to allow cooling to occur naturally to minimize process complexity, forced cooling by methods such as forced ambient or chilled air, a chilled roller or sled, and the like. If forced air cooling is used, it could be either attached to the tool or in the form of a general fan or blower blowing air over the entire assembly may be desired to increase assembly speed. Forced cooling may be desired when hot ambient conditions exist or if the screen bar is preheated, as described above.

Because the preferred mechanism of cooling in this aspect of the invention is heat sinking into the screen bar, it is important to use a minimum amount of adhesive to avoid a thick barrier of low conducting adhesive to interfere with heat flux of the hot adhesive to the screen bar.

As an example, when a small bead (e.g., about one sixteenth of an inch in diameter) of Bostik 7239 polyamide adhesive was used in conjunction with a single sled heated to 225° C., room temperature screen bars and no forced air auxiliary cooling, the cooling rate was found to be greater than the rate of heating. The excellent heat sinking characteristics inherent with the aluminum substrate facilitates this phenomenon. An acceptable speed of about six inches per second was achieved using a five inch long electrically heated sled.

Parenthetically, I have found that although the PVC coating on fiberglass-type screen may degrade upon contact with the heated tensioning tool 250, the integrity of the glass fibers within the strands of the screen is not significantly affected at the working temperatures of the heated tensioning tool 250. Also, the adhesive replaces the degraded PVC coating in and around the localized attachment area, thus further protecting the glass fibers. Of course, aluminum screen is unaffected by the heat of the tensioning tool 250. Further, I have found that adhesive bond can be lost if, for example, residual processing lubricants are not removed prior to applying the adhesive to the screen bar, if extreme and sudden temperature changes occur, if improper surface treatment or improper preheating of the screen bar is done, or if the adhesive is applied too cold. For these reasons, I prefer both mechanical and electrostatic bonding. If, for example, the electrostatic bond is lost because of excess processing lubricants, the mechanical interlocking assures bonding. As discussed above, perforations in the screen bar adjacent to the step are the preferred mechanical interlock.

As discussed above, in one aspect, this invention relates to a method of adhesively securing screen to screen bar segments of a screen frame, for example, by applying localized pressure to the screen, to tension the screen against a localized area of a tensioning step, while simultaneously heating the adhesive in the localized area such that the adhesive melts, flows and bonds to strands of the screen in the localized area, and then cools as heating in the localized area is removed, to secure the screen to the screen bar segments in the localized area. In another aspect, as an alternative to the foregoing method, the invention also provides a method of adhesively securing screen to screen bar segments of a screen frame by providing a screen frame comprised of segments of screen bar in the manner discussed above, in which each of the screen bar segments have a tensioning step along one side thereof, with adhesive being applied along the base of the tensioning step and, in this embodiment, heating the adhesive in a respective screen bar segment to a temperature sufficient to melt, spreading screen across the frame such that the screen passes over the tensioning step of the respective screen bar segment and applying localized pressure to the screen, to tension the screen against a localized area of the tensioning step of the respective screen bar segment, while simultaneously cooling the adhesive in the localized area such that the melted adhesive flows and bonds to the strands of the screen in the localized area, to secure the screen to the screen bar segments in the localized area. The step of applying localized pressure, while simultaneously cooling the adhesive, is repeated in a progressive manner, for the screen along each of the screen bar segments in the frame, to adhesively secure the screen to the screen bar segments of the screen frame.

This alternate method of adhesively securing screen to screen bar segments of a screen frame also can be combined with the earlier steps of the method of making a screen and frame assembly in which screen is adhesively secured to a screen frame, which earlier steps included making segments of screen bar, forming a tensioning step along one side of each screen bar segment, applying adhesive along the base of the tensioning step of each screen bar segment, allowing the adhesive to cool and thus, solidify, and forming the segments of the screen bar into a screen frame.

In this aspect of the present invention, the step of heating the adhesive in a respective screen bar segment to a temperature sufficient to melt can be effected in many ways. For example, the screen bar segments can be conductively heated either by heating each screen bar segment individually, or by heating the individual screen bar segments at the same time. In the alternative, the heating step may include directly heating the adhesive. I have found that all you need to do is heat the adhesive in a respective screen bar segment to a temperature sufficient to melt. To do this, when heating the adhesive by directly heating the screen bar segments, it may be necessary to raise the temperature of the screen bar to about 20° C. above the melt temperature of the adhesive.

To heat each screen bar segment individually, one can create an electrical circuit on each bar, for example, by setting electrodes at each end, such as at the corners. This type of electrical resistance heating is preferred, and can also be used to heat the entire screen frame using, for example, two electrodes. In this case, the corners could be modified to accept a plug-in electrode (e.g., for painted screen bar) or, for mill-finished metal bar, the electrodes merely need to contact the surface of the screen bar. In this type of heating, it is only necessary to apply a sufficient current to get fast heating. I have calculated that 1100 amps is required to heat a one meter by one meter aluminum screen frame from 20° C. to 150° C. in five seconds (or 550 amps is required to heat the frame from 20° C. to 150° C. in ten seconds).

Alternatively, induction heating can be used to heat the metal screen bar. For example, an induction coil adjacent to the screen bar would induce an electrical current flow in the screen bar to cause electrical heating.

As other alternatives, other heating techniques, such as a hot air blower oven, could be utilized to heat the adhesive in each screen bar segment, for example. However, I believe that such a technique would be inefficient and cumbersome.

Another alternative to heating each bar directly would be to place each bar in contact with a hot surface such as a table or a heating block using conduction. This method is effective, but slow, because the thermal mass in the element and in the bar does not allow fast enough cooling.

Another alternative would be to provide a heating element along the length of each bar. This too, however, may be cumbersome, since the heating element would have to be the same length as the screen bar segments and physically moved away for further processing. In this alternative, the heat would be run through a heating block, for example, which would conduct heat into the screen bar.

Once the adhesive in a respective screen bar segment has been heated to a temperature sufficient to melt, the heat is removed and, in this embodiment, the screen is rolled into the hot adhesive using a tensioning tool 250 including a tensioning roller 260 (which, in this embodiment, is chilled or cooled, rather than heated), by applying localized pressure to the screen, to tension the screen against a localized area of a tensioning step of a respective screen bar segment, while simultaneously cooling the adhesive in the localized area such that the melted adhesive flows and bonds to the strands of the screen in the localized area to secure the screen to the screen bar segments in the localized area. I have found that a sled may work, but may bunch the screen up when localized pressure is applied. Also, if the tool such as the roller is not chilled or cooled, the adhesive will stick to it. To prevent such sticking, it may also be necessary to coat the cooled tensioning tool 250 with a material such as Teflon (trademark).

I believe that this alternative method is faster than the earlier technique discussed above, because the temperature differential is reduced. In this embodiment, it is only necessary to heat the adhesive to a temperature sufficient to melt, and then cool it down some, sufficient to bond to the strands of screen in the localized area to which localized pressure has been applied by the cooling tool. Also, no smoke is generated, since the operating temperatures are much lower than using the other technique. Further, the cooling tool will not melt or put marks in the corners, which may occur using the heated tool, discussed above.

The cooled tensioning tool 250 may be a chilled roller internally cooled with water, for example. Aluminum may be utilized for its good conductivity. Most of the cooling water would be located on the outside perimeter of the cooled tensioning tool, such as the chilled roller. As an alternative, external cooling can be utilized such as by using an expanding gas, such as air, as the cooling medium (with carbon dioxide or nitrogen being preferred).

For the adhesive to bond to the strands of the screen, it is necessary for the adhesive to cool below its melt point. For this reason, in this embodiment, it is preferred to utilize an adhesive (such as a crystalline adhesive) having a sharp melt point, so that the adhesive solidifies soon after being cooled below its melt point.

If a chilled tensioning roller 260 is utilized, it is preferred to provide a groove in the bottom of the roller to push the screen into the adhesive, in the manner discussed herein. In this way, the adhesive is forced through the screen into the groove, and the screen is left embedded in the adhesive by the roller. As an example, when using screen bar segments having grooves approximately 0.140 inches across, the chilled tensioning roller 260 is typically about 0.100 inches across to have sufficient clearance on either side. This dimension is then divided equally or otherwise to provide the chilled tensioning roller having a groove utilized in this embodiment.

For any of the embodiments discussed herein, the adhesive also must provide adequate holding strength over the full range of service temperatures. Hot melt adhesives, particularly, polyester and polyamide adhesives have been shown to offer good flow and adhesive characteristics. Additionally, and when desired, these adhesives also provide good encapsulation (mechanical anchoring of the screen strands) characteristics.

Generally speaking, conventional thermoplastic resins such as polyamide, polyester, polycarbonate and the like tend to have higher than acceptable melt flow viscosities, resulting in lower than desired screen holding strength. I have found that straight polyamide (e.g., nylon) and polyester (PET) polymer resins (plastics) work only to a limited degree, since the viscosity and melt temperatures are higher with these pure resins. Also, these resins include none of the desirable additives, which lower viscosity and melt temperature and improve surface wetting (via surfactants). Although pure tensile holding strength may be achieved with high viscosity resins and adhesives, the lack of adequate holding strength can result in the glass filaments being easily ripped or torn in an area where the PVC coating has been degraded in fiberglass-type screens. Furthermore, the lack of adequate holding strength puts a greater demand on the electrostatic or adhesive bonding component.

The polyester and polyamide families of adhesives have shown good performance at elevated service temperatures. Therefore, these adhesives are preferred. Nevertheless, this invention is not limited to these adhesives. Rather, any suitable hot melt or equivalent adhesive or thermoplastic resin having the required heat resistance temperature and viscosity characteristics can be used.

With regard to service temperatures and creep resistance, the adhesive must have the ability to withstand service loading over the range of expected environmental temperatures. Loading consists of tension imparted to the screen during the assembly operation and the applied loads, while in its final location in a window opening, for example. Aside from slight wind loading, loading can come from a variety of sources, such as children, pets, mishaps, etc., and is entirely unpredictable. The strength requirements come from the applicable standards, which reflect consumer expectations.

The current load requirements as dictated by ANSI and CGSB standards are much greater than expected loading on the screen, but nevertheless, are the established standards which most manufacturers follow. My experiments show that in order to pass the CAN 79.1 standard, a retention strength of approximately 9 pounds per inch width of screen is required when the load is applied in the plane of the screen (i.e., tensile loading). This value was obtained from tests conducted at room temperature. This value was measured using a 1 inch long screen bar sample with a piece of screen 1 inch by 2 inches attached. A tab attached to the screen bar and coplanar with the screen was inserted into one jaw of an Instron tensile testing machine while the screen was inserted into the other jaw. Samples were then loaded to the break point, which was recorded.

Existing spline retention technology which meets this load requirement of 9 pounds at room temperature was measured to drop to approximately 4 pounds per inch at 60° C. At −40° C., there was not a significant change in retention strength compared to room temperature measurements. The strength of hot melt adhesives also decreases at elevated temperatures, but may increase at slightly lower temperatures. In the present invention, a strength of 30 to 35 pounds per inch was obtained at room temperature conditions using the Henkel 6206 adhesive. At 60° C., the strength was measured to be 20 pounds per inch. The present invention thus gives over three times higher retention strength over current spline technology over the range of service temperatures. This was unexpected!

In choosing a hot melt adhesive or thermoplastic resin to meet the requirements of hot weather conditions, one must review various temperature values specified by the manufacturers of these adhesives or resins. Specific values include melt and glass transition temperatures as measured using differential scanning calorimetry (DSC ASTM test #E 698), heat resistance temperature using ASTM test method #D 2293 and softening point, usually determined using the ball and ring test, ASTM #E 28. Generally, the ball and ring temperature is approximately 8 to 10° C. greater than the melt temperature for polyester and polyamide adhesives.

The most important temperature value relating to this invention is the heat resistance temperature, since this value indicates the temperature at which movement under load occurs. This is referred to as "creep". Typically, a 500 gram load is used on a 1 inch by 1 inch lap seam (as opposed to a butted seam). The heat resistance temperature is an indication of when an adhesive will begin to rupture under loaded conditions. Although adhesive can be chosen with site specific locations in mind, generally worst case conditions are assumed, since the screen manufacturers do not set site specific screens.

In short, the theoretical minimum heat resistance temperature allowable is the design ambient temperature. Nevertheless, I have found that, practically speaking, it is generally necessary to have a heat distortion temperature to perform in the ambient conditions expected. In most areas (excluding tropical climates), this temperature is considered to be about 35 to about 45° C. Although it is most preferred to have adequate strength to hold screen tension up to 85° C. for shipping in closed containers (as per MIL-STD A10), a reasonable upper ambient limit (desert) temperature is considered to be about 50° C., where full performance strength is required. With the sun directly hitting dark colored screen bars, an additional 20° C. can be reached. Thus, a preferred minimum heat resistance temperature is about 70° C. for service, and about 85° C. for shipping. In temperate climates, it is generally acceptable to have a heat resistance temperature of about 55° C. This compensates for a 35° C. upper limit on ambient temperatures and a 20° C. differential for sunshine on dark colors. In tropical climates, these values are 45° C. plus a 20° C. differential, which yields a minimum of about 65° C.

Incidentally, since the upper limit for ethylene vinyl acetate (EVA) type adhesives is generally considered to be about 75° C., this type of adhesive is acceptable from a temperature standpoint. However, EVA hot melt adhesives are not preferred because plasticizer migration from the screen may occur at elevated ambient temperatures resulting in loss in structural integrity, i.e., tensile strength.

In the adhesive industry, a 15 to 20° C. margin of safety is generally recommended between the heat resistance temperature of the adhesive used and the expected service temperature. Thus, an 85° C. service temperature expectation would suggest that the adhesive have a heat resistance temperature of about 100 to about 105° C. Adhesives in the polyamide or polyester family of hot melts meet this requirement. It is, however, more preferred to have an adhesive with a heat resistance temperature of about 120° C. This gives a 35° C. margin of safety over the 85° C. shipping temperature and 50° C. above the 70° C. dark color desert conditions under direct sunlight. Again, polyamide and polyester hot melt adhesives meet these values.

In view of the foregoing, I have determined that the adhesive should have a heat resistance temperature of not less than about 35° C. I prefer that the heat resistance temperature be between about 55° C. and about 180° C., with between about 85° C. and about 150° C. being more preferred and between about 100° C. and about 130° C. being most preferred.

I have found that thermoplastic (hot melt) adhesives or resins qualify for the present invention. These adhesives allow replacement of the screen by using a hot tool to first liquify and allow removal of the old screen, and then replacement in a manner discussed herein. If desired, and if the amount of adhesive is small enough, replacement screen also could be attached using conventional spline techniques, when using screen bar that has a spline groove.

The melting point value specified by the adhesive manufacturers is also important for this invention. This value is the temperature at which the adhesive begins to liquify and flow under shear stress.

In one aspect of the invention, when using a heated tensioning tool, it is important to use an adhesive whose melt temperature is low enough (e.g., about 100° to about 225° C. (maximum)) to allow a heated tool temperature within an operating range, which limits smoke production. Smoke can be generated from either the adhesive or the coating on the screen. I have found this range to be about 200° C. to about 500° C. for the preferred adhesives (with about 200° C. to about 400° C. being preferred, about 200° C. to about 300° C. being more preferred and about 250° C. to about 300° C. being most preferred) to provide an acceptable tool tensioning speed of approximately 4 to 5 inches per second with minimum smoke production. I have found that the corresponding maximum ball and ring temperatures of the adhesive are about 210° C. (acceptable), about 150° C. (preferred) and about 120° C. (most preferred).

I have found that hot melt adhesives selected from the group consisting of polyester, polyamide, polyolefin, polypropylene, polyurethane, butyl and ethylene vinyl acetate (EVA) will give satisfactory bond strength at room temperature (about 20° C. and below). However, only the polyester and polyamide adhesive families seem to perform particularly well at elevated temperatures. Although the EVA's may generally work well, I have found that they are not preferred due to excessive plasticizer migration, which may occur at elevated ambient temperatures. This causes loss of bond strength.

Table I shows polyamide and Table 2 shows polyester hot melt adhesives that I have found meet the high temperature requirements and melt flow characteristics. In these tables, the Macromelt adhesives are available from Henkel, Elgin, Illinois, whereas the Bostik adhesives are available from Bostik, Middleton, Massachusetts and the letter "a" indicates "acceptable" while the letter "p" indicates "preferred".

TABLE 1

| Polyamide Adhesive | Ball and Ring Temp. ° C. | Heat Resistance Temp. ° C. | Viscosity/ (temp.) Poise/(° C.) | Tensile Strength psi |
|---|---|---|---|---|
| Macromelt 6000-a | 200 | 155 | 4/(200) | 1900 |
| Macromelt 6202-p | 150 | 110 | 50/(210) | 450 |
| Macromelt 6206-a | 180 | 145 | 40/(210) | 1100 |
| Macromelt 6211-a | 145 | 125 | 25/(210) | 370 |
| Macromelt 6212-a | 110 | 80 | 35/(200) | 500 |
| Bostik 7239-p | 150 | 115 | 35/(200) | 385 |
| Bostik 4252-p | 150 | 110 | 22/(205) | 580 |
| Bostik 6240-a | 185 | 145 | 16/(230) | N/A |

TABLE 2

| Polyester Adhesive | Ball and Ring Temp. ° C. | Heat Resistance Temp. ° C. | Viscosity/ (temp.) Poise/(° C.) | Tensile Strength psi |
|---|---|---|---|---|
| Bostik 4101-p | 120 | 95 | 145(230) | 3400 |
| Bostik 4103-p | 135 | 110 | 425(225) | 2290 |
| Bostik 4156-a | 160 | 137 | 23(215) | 2700 |
| Bostik 4175-a | 200 | N/A | 900(225) | N/A |
| Bostik 4178-a | 145 | 120 | 1000(215) | 3000 |
| Bostik 5182-a | 150 | N/A | 900(215) | N/A |
| Bostik 7116-p | 150 | N/A | 340(200) | N/A |
| Bostik 7199-a | 190 | 170 | 200(215) | 700 |

Another property that appears to be important to this invention, and one that separates thermoplastic (hot melt) adhesive from thermoplastic resins (plastics) is surface wetting. On this point, melt viscosity is one of the most important properties of a hot-melt adhesive. In general, for a given adhesive, as the temperature increases, its viscosity decreases. Therefore, for a given hot-melt adhesive formulation, the temperature of the adhesive during application controls the viscosity, which greatly influences the extent of surface wetting. The bond formation temperature is the minimum below which surface wetting is inadequate. A hot-melt adhesive is applied at a running temperature, at which the viscosity is sufficient to wet surfaces. See the *Engineered Materials Handbook,* Vol. 3, "Adhesives and Sealants", ASM International Handbook Committee, page 80. For this invention, it is important that the adhesive not only melts and flows, but also has a wetting action to spread easily over the surface of the strands of the screen to secure and/or encapsulate them. Adhesive manufacturers add waxes and plasticizers as surfactants to promote surface wetting. The amounts of these additives remain proprietary to the adhesive manufacturers. Loads applied to the screen must be carried by the adhesive. I have found that the adhesives listed in Tables I and II give acceptable bond and tensile strength to meet the load requirements of the installation. Generally, the tensile strength of the adhesive must be over 300 psi to effectively carry the loads. Strand encapsulation enhances bond strength between the screen and the adhesive and mechanical interlocking between the adhesive and the screen is preferred to ensure full bond potential. Perforations in the screen bar, discussed above, is the preferred method of mechanical interlocking.

There was an initial concern that polyamide adhesives would soften over time while in contact with plasticized PVC screen, due to the potential plasticizer migration. (Polyester adhesives do not have the same susceptibility to plasticizer migration and thus, softening characteristics.) This concern with polyamide adhesives, however, has not been demonstrated in practice. It is believed that the amount of plasticizer available for migration is very low. For this reason, polyamides are, along with polyester adhesives, preferred.

Good weathering characteristics also must be provided, since many screen assemblies are exposed to full sunlight and extreme whether conditions. Industry standards generally demand mechanical properties to be maintained over a ten year period. However, twenty years is preferred.

To enhance the mechanical properties, it is generally known to add to the adhesive carbon black for blocking ultraviolet (UV) light, as well as light absorbers and light stabilizers. Also, adding enough carbon black to make the adhesive opaque is sufficient to block UV light. Generally, 0.5 to 2% by weight of the adhesive is adequate to block UV light, and 1 to 1.5% by weight is sufficient to make the adhesive opaque. I have found that diminishing returns are experienced above 2%, and that mechanical properties also can be adversely affected. Benzotriazole is a suggested additive to act as a UV absorber for both polyamide and polyester adhesives. An example is Tinuvin 234, available from Ciba-Geigy, which is a 100% active chemical. This chemical can be added to the adhesive in an amount of 0.05% to 0.3%, with 0.1% be a typically specified amount, by weight.

Products which act as "hindered amine light stabilizers" (HALS) are also added to the adhesive, in an amount between 0.05 to 0.3% by weight. I have found that 0.1% is a typically specified amount. Tinuvin 622, available from Ciba-Geigy, is a 100% HALS and is recommended for polyamide and polyester adhesives.

Incidentally, I believe that using the accepted adhesives in a foamed form (with 20%–70% lower density) has an advantage for this invention by giving a larger bead size, for example, for a given mass per unit length—thus, lowering cost. A larger diameter bead increases the bonding area, which improves the bond strength. Also, the insertion speed will theoretically increase, as less mass is heated and melted from a given bead size. A Nordson model FM190 hot-melt dispensing unit is designed to apply foamed adhesives in bead form. Nitrogen is generally used as the foaming agent in such foamed adhesives.

The scope of the invention is not limited by the foregoing discussion, but only by each of the following claims, which should be interpreted as broadly as possible to encompass all modifications and equivalent structures without encompassing the prior art or invalidating the claim. For example, although I have discussed hot melt adhesives and thermoplastic resins above, I envision that pressure sensitive adhesives and like bonding agents that provide equivalent results also could be used, as desired.

I claim:

1. A screen and screen frame assembly comprising:

screen formed of open weave ventilation material;

a plurality of segments of screen bar secured together to form a screen frame, each of the plurality of screen bar segments including a U-shaped tensioning step extending along a front face of the screen bar segment, the front faces of the segments defining a plane containing a portion of the screen lying between the plurality of screen bar segments of the frame, the open side of the U-shaped tensioning step being in the plane of the front face, the base of the U-shaped tensioning step being substantially parallel to and offset from the front face; and adhesive applied along the base of the tensioning step of each of the screen bar segments, the adhesive being applied in an amount sufficient to encapsulate the screen, the screen being spread across the front face of the screen frame, and, for each of the screen bar segments, the screen being tensioned by the tensioning step along the front face of the respective screen bar segment, encapsulated in the adhesive, and bonded by the adhesive to the base of the tensioning step of the respective screen bar segment.

2. An assembly according to claim 1, in which the adhesive is a hot melt adhesive selected from the group consisting of polyester, polyamide, polyolefin, polypropylene, polyurethane, butyl and ethylene vinyl acetate based adhesives.

3. An assembly according to claim 1, in which the adhesive has a heat resistance temperature between about 550° and about 180° C. and a viscosity of at most about 1200 poise at about 200° C.

4. An assembly according to claim 1, in which the adhesive has a heat resistance temperature between about 85° C. and about 150° C. and a viscosity of at most about 1000 poise at about 200° C.

5. An assembly according to claim 4, in which the adhesive has a heat resistance temperature between about 100° C. and about 130° C.

6. An assembly according to claim 1, in which the adhesive is applied as a film to provide a layer having a thickness between about 0.003 to about 0.020 inches.

7. An assembly according to claim 6, in which the adhesive is applied as a bead to provide a layer having a thickness between about 0.020 to about 0.250 inches.

8. An assembly according to claim 7, in which the adhesive is applied to provide a layer having a thickness between about 0.030 to about 0.150 inches, which is sufficient to encapsulate strands of the screen.

9. The screen and frame assembly of claim 1, wherein the screen is encapsulated so that the adhesive lies at or above a top of the screen cloth at the base of the tensioning step.

10. The screen and frame assembly of claim 1, wherein the screen is encapsulated so that a top surface of screen cloth at the base of the tensioning step lies at or beneath a top surface of the adhesive at the base of the tensioning step.

11. A screen and screen frame assembly comprising:

a plurality of screen bar segments, each formed so as to have a stress-free outwardly bowed state and a stressed state in which the segment is substantially straight, the plurality of screen bar segments being secured together to form the screen frame, each of the plurality of screen bar segments including a tensioning step along one side thereof;

adhesive applied along the base of the tensioning step of each of the screen bar segments; and screen comprising open weave ventilation material spread across the screen frame, tensioned and bonded to the base of the tensioning step of each screen bar segment by the adhesive, so that the screen bar segments are in the substantially straight stressed state when the screen is bonded to screen bar segments, the portion of the screen in contact with the adhesive being encapsulated by the adhesive, for each of the plurality of screen bar segments.

12. An assembly according to claim 11, in which the adhesive is a hot melt adhesive selected from the group consisting of polyester, polyamide, polyolefin, polypropylene, polyurethane, butyl and ethylene vinyl acetate based adhesives.

13. An assembly according to claim 11, in which the adhesive has a heat resistance temperature between about 55° and about 180° C. and a viscosity of at most about 1200 poise at about 200° C.

14. An assembly according to claim 11, in which the adhesive has a heat resistance temperature between about 85° C. and about 150° C. and a viscosity of at most about 1000 poise at about 200° C.

15. An assembly according to claim 14, in which the adhesive has a heat resistance temperature between about 100° C. and about 130° C.

16. An assembly according to claim 11, in which the adhesive is applied to provide a film layer having a thickness between about 0.003 to about 0.020 inches.

17. The screen and frame assembly of claim 11, wherein the screen is encapsulated so that the adhesive lies at or above a top of the screen cloth at the base of the tensioning step.

18. The screen and frame assembly of claim 11, wherein the screen is encapsulated so that a top surface of screen cloth at the base of the tensioning step lies at or beneath a top surface of the adhesive at the base of the tensioning step.

19. A screen and screen frame assembly comprising:

a plurality of segments of screen bar secured together to form a screen frame, each of the plurality of screen bar segments including a tensioning step along one side thereof;

hot melt adhesive applied along the base of the tensioning step of each of the screen bar segments, the adhesive being applied in an amount to provide a layer having a sufficient thickness so that strands of screen are encapsulated by the adhesive when screen is secured to the screen bar; and screen comprising plasticized polymer coated open weave ventilation material spread across the screen frame, tensioned and hot melt bonded to the base of the tensioning step by the adhesive such that strands of screen are encapsulated by the adhesive, for each of the plurality of screen bar segments.

20. An assembly according to claim 19, in which the adhesive is a hot melt adhesive selected from the group consisting of polyester, polyamide, polyolefin, polypropylene, polyurethane, butyl and ethylene vinyl acetate based adhesives.

21. An assembly according to claim 19, in which the adhesive has a heat resistance temperature between about 550° and about 180° C. and a viscosity of at most about 1200 poise at about 200° C.

22. An assembly according to claim 19, in which the adhesive has a heat resistance temperature between about 85° C. and about 150° C. and a viscosity of at most about 1000 poise at about 200° C.

23. An assembly according to claim 22, in which the adhesive has a heat resistance temperature between about 100° C. and about 130° C.

24. An assembly according to claim 19, in which the adhesive is applied to provide a layer having a thickness between about 0.030 to about 0.150 inches, which is sufficient to encapsulate the strands of the screen.

25. The screen and frame assembly of claim 19, wherein the hot melt adhesive is polyamide.

26. The screen and frame assembly of claim 19, wherein the plasticized polymer is plasticized poly vinyl chloride.

27. The screen and frame assembly of claim 19, wherein the ventilation material is plasticized polymer coated fiberglass.

28. The screen and frame assembly of claim 19, wherein:

the hot melt adhesive is polyamide;

the plasticized polymer is plasticized poly vinyl chloride; and the ventilation material is plasticized polymer coated fiberglass.

29. The screen and frame assembly of claim 19, wherein the hot melt adhesive is polyamide.

30. The screen and frame assembly of claim 19, wherein the screen is encapsulated so that the adhesive lies at or above a top of the screen cloth at the base of the tensioning step.

31. The screen and frame assembly of claim 19, wherein the screen is encapsulated so that a top surface of screen cloth at the base of the tensioning step lies at or beneath a top surface of the adhesive at the base of the tensioning step.

32. A screen and screen frame assembly, comprising:

a plurality of segments of screen bar secured together to form a screen frame, each of the plurality of screen bar segments including a tensioning step along one side thereof;

hot melt adhesive applied along the base of the tensioning step of each of the screen bar segments, the adhesive being applied in an amount to provide a layer having a sufficient thickness so that strands of screen are encapsulated by the adhesive when screen is secured to the screen bar; and screen comprising polymer coated open weave ventilation material spread across the screen frame, tensioned and hot melt bonded to the base of the tensioning step by the adhesive such that strands of screen are encapsulated by the adhesive, for each of the plurality of screen bar segments.

33. The screen and frame assembly of claim 32, wherein the ventilation material is plasticized polymer coated fiberglass.

34. The screen and frame assembly of claim 32, wherein the screen is encapsulated so that the adhesive lies at or above a top of the screen cloth at the base of the tensioning step.

35. The screen and frame assembly of claim 32, wherein the screen is encapsulated so that a top surface of screen cloth at the base of the tensioning step lies at or beneath a top surface of the adhesive at the base of the tensioning step.

* * * * *